United States Patent [19]

Sayles et al.

[11] 4,436,613

[45] Mar. 13, 1984

[54] TWO STAGE CATALYTIC CRACKING PROCESS

[75] Inventors: Scott M. Sayles; Leonce F. Castagnos, Jr., both of Nederland; Charles H. Schrader, Groves, all of Tex.; Edward W. Dillingham, Ontario, Calif.; Richard P. Scott, deceased, late of Groves, Tex., by Candice Chord Scott, executrix

[73] Assignee: Texaco Inc., White Plains, N.Y.

[21] Appl. No.: 446,812

[22] Filed: Dec. 3, 1982

[51] Int. Cl.[3] ..... C10G 51/02; B01J 8/26; B01J 8/28

[52] U.S. Cl. ..... 208/74; 208/77; 208/155; 208/156; 208/97; 422/142; 422/144; 502/42

[58] Field of Search ..... 208/74, 75, 76, 77, 208/155, 164; 252/417

[56] References Cited

U.S. PATENT DOCUMENTS

| | | | |
|---|---|---|---|
| 2,444,131 | 6/1948 | Delattre-Seguy | 208/74 |
| 2,461,958 | 2/1949 | Bonnell | 208/74 |
| 3,143,491 | 8/1964 | Bergstrom | 208/74 |
| 3,494,858 | 2/1970 | Luckenbach | 208/164 |
| 3,761,391 | 9/1973 | Conner | 208/74 |
| 3,856,659 | 12/1974 | Owen | 208/80 |
| 3,894,933 | 7/1975 | Owen et al. | 208/77 |
| 4,116,814 | 9/1978 | Zahner | 208/155 X |

*Primary Examiner*—Delbert E. Gantz
*Assistant Examiner*—O. Chaudhuri
*Attorney, Agent, or Firm*—Robert A. Kulason; James F. Young; Robert Knox, Jr.

[57] ABSTRACT

A two-stage cascade flow fluid catalytic cracking process capable of converting high molecular weight hydrocarbons containing catalyst poisons into products of lower molecular weight with high activity cracking catalyst susceptible to catalyst poisons, the cascade flow process resulting in higher yields of desired motor fuel fractions than those obtainable with conventional riser flow fluid catalytic cracking processes. Catalyst poisons, e.g. nitrogen compounds, sulfur compounds, heavy metal compounds and high Conradson Carbon Residues, are removed from the heavy hydrocarbon charge stocks by first contacting the charge stock containing catalyst poisons with a low activity catalyst comprising used catalyst from the process under fluid catalytic cracking reaction conditions effective for the conversion of a minor portion of the heavy feed hydrocarbons to hydrocarbons of lower molecular weight, recovering gas oils from the products of said first fluid catalytic cracking reactor and subjecting the gas oils to more severe cracking conditions in the presence of high activity cracking catalyst, e.g. a molecular sieve catalyst.

15 Claims, 1 Drawing Figure

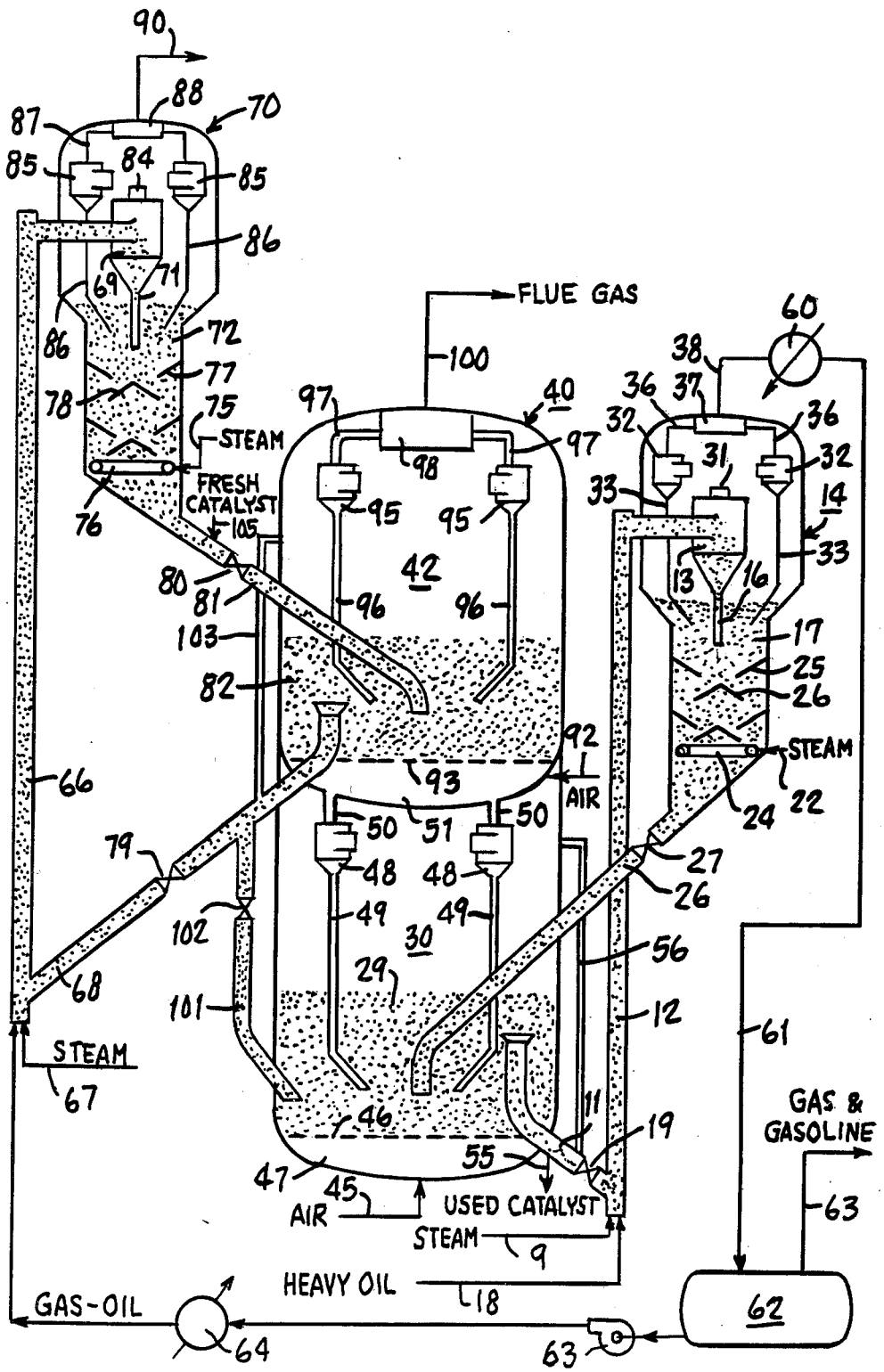
FLUE GAS
STEAM
FRESH CATALYST
STEAM
AIR
STEAM
GAS & GASOLINE
AIR
USED CATALYST
STEAM
HEAVY OIL
GAS-OIL

TWO STAGE CATALYTIC CRACKING PROCESS

This invention relates to a two-stage fluidized catalytic cracking (FCC) process. In one of its more specific aspects, it relates to a two stage cascade flow FCC process for converting high molecular weight hydrocarbon feedstocks containing large amounts of catalyst poisons into lower molecular weight hydrocarbons by removing the catalyst poisons in a first stage and further converting the total gas oil from the first stage in a second stage under more favorable cracking conditions. In another of its more specific aspects, the invention relates to cracking a high molecular weight hydrocarbon feedstock containing FCC catalyst poisons such as an atmospheric residuum or oil from a deasphalted vacuum residuum from conventional petroleum refining operations. In still another of its more specific aspects, the invention relates to the cracking of synthetic high molecular weight charge stocks containing FCC catalyst poisons, such as tar sands bitumen and shale oil.

Fluidized catalytic conversion (FCC) processes for converting high molecular weight hydrocarbon stocks to more valuable lower molecular weight hydrocarbon products are well known. In recent years, refineries are faced with the problem of processing feedstocks containing increasing amounts of high molecular weight materials with corresponding increases in FCC catalyst poisons. Catalyst poisons commonly encountered are heavy metals contained in heavy crude oils and their residua and in synthetic crude oils derived from oil shales and tar sands. The use of passivating agents to reduce the effect of the metal components of the charge stock as FCC catalyst poisons while reducing some of their adverse effects, such as high coke and hydrogen yields, does not significantly increase the debutanized naphtha or light cycle gas oil yields and, as such, is not entirely effective.

The FCC catalyst poisons are of two types; the first consists of a group of temporary poisons, such as nitrogen-containing compounds contained in the charge stock or the coke formed from high Conradson Carbon Residue charge stocks during the cracking reaction. These types of poisons can be removed during the regeneration step of the FCC process and do not affect the intrinsic equilibrium activity of the catalyst. The effective "cracking" activity however, is affected by this type of poison. It is thus desirable to remove these and other catalyst poisons and then subject the total gas oil to cracking in the presence of a high activity cracking catalyst. The second type of catalyst poisons consists of a group of permanent catalyst poisons, such as vanadium, nickel or other heavy metal compounds. These types of poisons are not removed during regeneration of cracking catalysts and the equilibrium activity of the catalyst is permanently reduced by these poisons. These metals on the catalyst particles are active sites for the promotion of dehydrogenation reactions which lead to the increased production of hydrogen, gas and coke with a resulting decrease in liquid yields. For the case of metals type poisons, the use of passivating agents employing antimony, tin, and/or germanium would be desirable to reduce the hydrogen make and coke yields.

In a typical fluidized catalytic cracking process, a hydrocarbon oil feedstock is contacted with a particulate hydrocarbon conversion catalyst in a reaction zone under conditions such that the hydrocarbon feedstock is converted into desired products of lower molecular weight accompanied by the production of hydrogen and other gaseous by-products and the deposition of coke on the surface of the catalyst particles. Such systems may comprise one or more riser reactors, transport type reaction zones, through which vaporized hydrocarbons and solid particulate catalyst suspended in the hydrocarbon vapors, optionally mixed with steam, are concurrently passed. Reaction products and catalyst are discharged from the transport type reaction zone into a separation zone in which hydrocarbon vapors are separated from the catalyst. During its passage through the reaction zone, the catalyst becomes partially deactivated due to the deposition of coke on the surface of the catalyst. This partially deactivated catalyst is commonly referred to as "spent" catalyst as contrasted with regenerated or fresh catalyst. Catalyst which has been regenerated by combustion of such deposits by means of an oxygen-containing gas has a lower coke content and higher catalytic activity than spent catalyst from the reaction zone.

In the regeneration of cracking catalysts, the spent catalyst from the reaction zone is first contacted in a stripping zone with a stripping medium, usually steam, to remove vaporizable entrained and occluded hydrocarbons from the catalyst. From the stripping zone, stripped catalyst is passed into a regeneration zone wherein the stripped catalyst is regenerated by burning coke deposits from the catalyst with an oxygen-containing gas, usually air. The resulting hot regenerated catalyst from the regeneration zone is then recycled to the reaction zone into contact with additional hydrocarbon feedstock.

Hydrocarbon vapors from the reaction zone are cooled and partially condensed and may be processed for the recovery of normally liquid hydrocarbons from normally gaseous hydrocarbons and the liquid fractions separated into desired product fractions according to their chemical characteristics or boiling ranges. For example, liquid hydrocarbons recovered from the product effluent from a fluidized catalytic cracking unit may be separated by fractional distillation into a gasoline and lighter components fraction, a light cycle gas oil fraction, an intermediate cycle gas oil fraction, and a heavy cycle gas oil bottoms, or residual, fraction.

The yield of desirable products from a given hydrocarbon charge to a fluidized catalytic cracking process may be controlled within certain limits by selection of the catalyst; the hydrocarbon conversion conditions within the reaction zone, i.e., the temperature, pressure and catalyst-oil contact time; and the catalyst-to-oil ratio best suited for processing a particular charge stock.

The process of this invention provides a method for producing a high yield of liquid products, particularly motor fuel blending stocks, from heavy oil feedstocks containing catalyst poisons by utilizing low activity catalyst in conjunction with a catalyst of high activity in separate riser reactors.

In accordance with this invention, there is provided an improved process for catalytically cracking a heavy hydrocarbon charge stock containing catalyst "poisons" in the presence of a zeolite cracking catalyst susceptible to poisoning or loss of activity during use by reason of certain components of the charge stock. In this process, the charge stock is subjected to a first fluid catalytic conversion reaction utilizing a catalyst of relatively low catalytic activity under conditions such that only 40 volume percent or less of the charge stock is converted to lower molecular weight hydrocarbons, effecting removal of catalyst poisons from the feedstock. The whole gas oil fraction from the first catalytic conversion step is then subjected to a second fluid catalytic conversion reaction in the presence of a catalyst of relatively high catalytic activity under conditions effective for conversion of a further portion of the gas oil fraction to products of lower molecular weight.

The present invention provides a two-stage fluidized catalytic cracking process which permits precise control of reaction time and temperature in each stage for optimum conversion conditions for processing any given hydrocarbon feedstock. Control of the extent of conversion in each FCC zone is accomplished in the process and apparatus of the present invention by separately contacting in each FCC zone, preheated oil feedstock with hot regenerated catalyst selected for the particular feedstock. A suspension of catalyst in a mixture of steam, oil vapors and reaction products is passed in cocurrent flow through a vertical riser reactor. After a relatively short time of contact between the feedstock and catalyst, the reaction products are separated from the catalyst and the used or spent catalyst from the reaction is contacted with stripping steam. The spent catalyst from each riser reactor is separately regenerated in a novel combination of regeneration zones which comprise a first dense phase catalyst bed regeneration zone and a second dense phase catalyst bed regeneration zone. The two catalyst regeneration zones are so constructed and arranged as to provide maximum utilization of heat liberated by the exothermic regeneration reactions and simplification of emissions control. Flue gases leaving the first catalyst regeneration zone pass into the second catalyst regeneration zone as fluidizing gas and regeneration gas for the second dense phase bed catalyst regeneration zone. The flue gases discharged from the second catalyst regeneration zone comprise all of the flue gas from the first, thus simplifying heat recovery and noxious gas removal from the two separate regeneration zones, as described more fully hereinafter.

It is already known in the prior art from U.S. Pat. No. 3,835,029, that the contact time between hydrocarbon conversion reactants and catalyst may be controlled within the range of from 0.2 to 5 or more seconds by suspending a particulate solid catalyst in a mixture of hydrocarbon feed and steam in a transport type cocurrent flow catalytic cracking zone in which the velocities of the reactants and catalyst are within the range of about 30 to 100 feet per second.

A preferred embodiment of the process and apparatus of this invention is described herein with reference to the accompanying drawing.

The FIGURE is a diagrammatic cross-sectional representation of a preferred form of apparatus forming a part of the present invention and suitable for illustrating and carrying out the process of this invention.

With reference to the FIGURE, a preheated heavy hydrocarbon feedstock containing FC catalyst poisons is supplied to the process through line 18. The feedstock is introduced into the lower end of a vertical dilute phase riser reactor 12 where it is mixed with steam supplied through line 9 and hot regenerated catalyst from a source described hereinafter supplied to reactor 12 via standpipe 11. The velocity of the catalyst, oil, and steam in riser reactor 12 is sufficient to preclude substantial settling or backmixing of catalyst in the reactor. The mixture of catalyst, steam, and hydrocarbon vapors passes through the reaction zone 12 into a cyclone separator 13 in separator vessel 14 wherein the bulk of the catalyst is separated from the hydrocarbon conversion products. Catalyst is discharged from the cyclone separator 13 through line 16 into a dense phase fluidized bed of catalyst in the lower part of vessel 14 which comprises a catalyst stripper 17.

Conversion of the heavy hydrocarbon feed in the riser reactor 12 is preferably limited to 40 volume percent or less by control of time, temperature and catalyst activity in the riser reactor. The desired reaction temperature within the riser reactor 12 is obtained by adjusting a slide valve 19 which regulates the amount of hot regenerated catalyst supplied to the reactor from standpipe 11.

Catalyst separated from the reaction products in separator 13 is stripped with steam supplied from line 22 to distributor ring 24 in the lower part of vessel 14. Baffles 25 and 26, suitably circular in plan view, not shown, provide intimate contact between stripping steam and catalyst in the stripping section 17 of vessel 14. From the bottom of vessel 14, stripped catalyst flows downwardly through slide valve 27 and standpipe 26 into a primary dense phase fluidized bed 29 of catalyst in regeneration zone 30, described in more detail hereinafter.

Steam rising through the stripping section 17 of vessel 14 removes occluded and entrained hydrocarbons from the catalyst. The steam and stripped hydrocarbon vapors pass upwardly through the dense phase fluidized bed of catalyst and are disengaged from the catalyst in the upper portion of vessel 14 which preferably has an enlarged cross-sectional area relative to that of stripping section 17 to reduce the gas velocity in the upper section of the vessel and thereby facilitate separation of catalyst from steam and hydrocarbon vapors.

Vaporized products of reaction from the dilute phase reaction zone 12, separated from spent catalyst in cyclone separator 13, still contain suspended particles of catalyst. These vapors are discharged from the cyclone separator into the dilute phase section of vessel 14 through outlet 31 into admixture with steam and hydrocarbon vapors from stripping section 17. A mixture of steam and vaporized hydrocarbons containing entrained particles of catalyst enters cyclone separators 32 wherein entrained catalyst is separated from the hydrocarbon vapors and returned to the catalyst bed through diplegs 33. Although only two cyclone separators 32 are illustrated in the FIGURE, it will be understood that several such separators may be assembled in parallel and in series to achieve substantially complete separation of solid particles of catalyst from the mixture of hydrocarbon vapors and steam and that a plurality of such assemblies may be employed to handle the relatively large volume of vapor which normally are present in this part of the process. Effluent gases and vapors from separators 32 pass through lines 36 into plenum 37 where gases from the cyclone assemblies, not shown, are collected and discharged from the vessel 14 through line 38 for further processing.

Catalyst regenerator 30, as illustrated in the FIGURE, comprises one section of a vessel 40 containing two complete fluid bed catalyst regeneration systems, referred to herein as a lower regenerator 30 and an upper regenerator 42. In regenerator 30, a dense phase fluidized bed of spent catalyst from stripper 17 is contacted with primary regeneration air introduced through line 45 to air distributor grid 46 which distributes the regeneration air uniformly across the fluidized catalyst bed. The air distributor may comprise a packed bed of pellets or spheres, e.g. high density alumina or ceramic spheres or pellets in the "⅛" by "⅛" range, not illustrated, which permit air to flow from a plenum 47 into the bottom of the fluidized bed 29 of catalyst in regenerator 30, and prevent backflow of catalyst if air flow to the regenerator is interrupted. An air distributor consisting of wire screen layers, pressed and sintered to form a permeable plate with a low air pressure drop yet impermeable to particulate catalyst, such as that marketed by Michigan Dynamics, Garden City, Mich., may be used in place of the packed bed of pellets or spheres.

Alternatively, the air distributor may comprise a pipe grid or ring with nozzles protruding into the catalyst bed from the ring as disclosed, for example, in U.S. Pat. No. 4,035,153. The functions of the nozzles are two fold (1) to distribute air evenly across the regenerator catalyst bed and (2) to prevent catalyst back flow into the pipe grid or ring.

Oxygen from the air burns accumulated coke from the catalyst in the fluidized bed 29 thereby regenerating the catalyst. Flue gases resulting from the combustion of coke pass upwardly from the dense phase bed 29 and enter cyclone separators 48 wherein entrained catalyst is separated from the flue gases and returned to the dense phase bed through diplegs 49. Although two cyclone separators 48 are represented in the FIGURE, it will be understood that cyclone separators 48 may comprise assemblies of cyclone separators arranged in parallel and in series in known manner to effect substantially complete separation of entrained solid particles from the flue gases. Effluent gases from the cyclone separators 48 pass through lines 50 into plenum 51 in the lowermost part of the upper regenerator 42.

Regenerated catalyst withdrawn from the bottom of the regenerator 30 through standpipe 11 supplies hot regenerated catalyst to riser reactor 12 as described above. A portion of the used catalyst withdrawn from the regenerator 30 may be discarded from the system through line 55. A vent pipe 56 connects standpipe 11 to the dilute phase section of regenerator 30.

Product vapors from separator 14 pass through line 38 to a condenser 60 wherein the product vapor is cooled by an amount sufficient to condense the gas oil fractions, i.e. hydrocarbons boiling above 210 C. (410 F.). Components boiling below 210 C. comprising gases, condensate water and motor fuel components are separated from the 210 C. plus or total gas oil fraction which forms the charge stock for a second riser reactor. The total gas oil fraction is contacted with high activity cracking catalyst in the second riser reactor for the production of further amounts of motor fuel components. The two stage cracking process of this invention results in improved yields of desirable products as compared with conventional cracking using a single catalyst.

Cracking of the heavy oil feedstock containing FC catalyst poisons in riser reactor 12 removes a substantial proportion of each of the catalyst poisons from the hydrocarbon products of reactor 12 so that the gas oil feedstock recovered from the reaction products contains substantially reduced amounts of Conradson Carbon Residue, sulfur, nitrogen and heavy metals, all of which are catalyst poisons. Some of the FC catalyst poisons removed from the charge stock are deposited on the surface of the catalyst at the expense of equilibrium catalyst activity. Thus, this side of the process is termed the low activity side. Once either the permanent or temporary catalyst poisons have been removed from the hydrocarbons, the resultant total gas oil may be charged to an FCC reactor employing a high activity catalyst. As there are substantially no permanent catalyst poisons remaining in the feedstock derived from the products of riser reactor 12, the activity of the catalyst employed in the second riser reactor remains at a very high level. This portion or side of the process is referred to herein as the high activity side.

Condensate from condenser 60 passes through line 61 to accumulator drum 62 wherein the condensate gas oil fraction is separated from gases and hydrocarbons lower boiling than the gas oils, e.g. those boiling below 210 C. The lower boiling hydrocarbons are discharged from accumulator drum 62 through line 63 for separation and recovery.

The gas oils, e.g. the product fraction boiling above 210 C., is withdrawn from accumulator drum 62 by pump 63, preheated in heater 64 and introduced into the lower end of a vertical dilute phase riser reactor 66 where it is mixed with steam supplied through line 67 and hot regenerated catalyst from regenerator 42 supplied to reactor 66 via standpipe 68. Reheat of gas oils in heater 64 may be accomplished by combining condensor 60 and heater 64 to effect heat exchange between the hydrocarbon product stream 38 and the gas oil stream. The velocity of the catalyst, oil and steam in riser reactor 66 is sufficient to preclude substantial settling or backmixing of catalyst in the reactor. A mixture of catalyst, steam, and hydrocarbon vapors is discharged from the reaction zone 66 into a cyclone separator 69 in separator vessel 70 wherein the bulk of the catalyst is separated from the hydrocarbon conversion products. Catalyst is discharged from the cyclone separator 69 through line 71 into a dense phase fluidized bed of catalyst in the lower part of vessel 70 which comprises a catalyst stripper 72.

Substantial conversion of the Feed occurs, e.g. 65–70 volume percent of the total gas oil, in the riser reactor 66 under controlled conditions of time and temperature. The desired reaction temperature within the riser reactor 66 is obtained by adjusting slide valve 79 which regulates the amount of hot regenerated catalyst supplied to the reactor from standpipe 68.

Catalyst separated from the reaction products in separator 69 is stripped with steam supplied from line 75 to distributor ring 76 in the lower part of vessel 72. Baffles 77 and 78, suitably circular in plan view, not shown, provide intimate contact between stripping steam and catalyst in the stripping section 72 of vessel 70. From the bottom of vessel 70, stripped catalyst flows downwardly through slide valve 80 and standpipe 81 into a primary dense phase fluidized bed of catalyst 82 in regeneration zone 42, described in more detail hereinafter.

Steam rising through the stripping section 72 of vessel 70 removes occluded and entrained hydrocarbons from the catalyst. The steam and stripped hydrocarbon vapors pass upwardly through the dense phase fluidized bed of catalyst and are disengaged from the catalyst in the upper portion of vessel 70 which preferably has an enlarged cross-sectional area relative to that of stripping section 72 to reduce the gas velocity in the upper section of the vessel and thereby facilitate separation of catalyst from steam and hydrocarbon vapors.

Vaporized products of reaction from riser reactor 66 separated from spent catalyst in cyclone separator 69, still contain suspended particles of catalyst. These vapors are discharged from the cyclone separator through outlet 84 into the dilute phase section of vessel 70 into admixture with steam and hydrocarbon vapors from stripping section 72. A mixture of steam and vaporized hydrocarbons containing entrained particles of catalyst enters cyclone separators 85 wherein entrained catalyst is separated from the hydrocarbon vapors and returned to the catalyst bed 72 through diplegs 86. Although only two cyclone separators 85 are illustrated in the FIGURE, it will be understood that several such separators may be assembled in parallel and in series to achieve substantially complete separation of solid particles of catalyst from the mixture of hydrocarbon vapors and steam and that a plurality of such assemblies may be provided within the upper part of separator vessel 70. Effluent gases and vapors from separators 85 pass through lines 87 into plenum 88 where gases from the cyclone assemblies, not shown, are collected and discharged from the vessel 70 through line 90 for further processing.

Catalyst regenerator 42, as illustrated in the FIGURE, comprises the upper section of vessel 40. In upper regenerator 42, a dense phase fluidized bed 82 of spent catalyst from stripper 72 is contacted with flue gases from regenerator 30. Additional air for burning accumulated coke from the catalyst in the fluidized bed 82 and thereby regenerating the catalyst may be supplied through line 92 to supplement oxygen contained in the flue gases resulting from the combustion of coke in the lower dense phase bed 29. The flue gases and secondary regeneration air are introduced through plenum 51 to air distributor grid 93 which distributes the regeneration air uniformly across the fluidized catalyst bed. As in regenerator 30, air distributor grid 93 may comprise a packed bed of ceramic pellets or spheres, porous sintered wire screen plate, or a pipe grid and/or ring.

Flue gases resulting from combustion of coke in dense phase fluid beds 29 and 82 pass upwardly from dense phase fluid bed 82 and enter cyclone separators 95 wherein entrained catalyst is separated from the flue gases and returned to the dense phase bed through diplegs 96. Although two cyclone separators 95 are represented in the FIGURE, it will be understood that cyclone separators 95 may comprise assemblies of cyclone separators arranged in parallel and in series in known manner to effect substantially complete separation of entrained solid particles from the flue gases. Effluent gases from the cyclone separators 95 pass through lines 97 into plenum 98 and are discharged through line 100.

Regenerated catalyst withdrawn from the bottom of the regenerator 42 through standpipe 68 supplies hot regenerated catalyst to riser reactor 66 as described above. A portion of the used catalyst withdrawn from the regenerator 42 may be passed through standpipe 101 to the dense phase bed 29 in lower regenerator 30 as controlled by slide valve 102 to replenish catalyst in regenerator 30 as needed. A vent pipe 103 connects standpipe 68 to the dilute phase section of regenerator 42. Fresh catalyst may be added to regenerator 42 through line 105.

For both the low and high activity sides short (1 to 6 seconds) contact time cracking is employed. To keep the catalyst oil contact time short and to achieve excellent oil and catalyst contact, vertical risers are provided which terminate in a "side outlet T" with the side outlet of the T discharging into rough cut cyclone separators. The oil charge preferably is introduced into the riser reactors through sintered ceramic disks or multiple nozzle feed injectors.

All fresh catalyst additions are made to the high activity side so that catalyst can be moved from the high activity, upper regenerator bed, to the low activity, bottom regenerator bed. In this manner, catalyst flow will be counter to oil, providing for excellent catalyst activity maintenance on the high and low activity sides as the fresh catalyst is added only to the activity side of the process. Preferred catalysts are commercial zeolite cracking catalysts, for example Davison "CBZ Type" catalysts. The catalyst may comprise a platinum group metal promoter, e.g. platinum, to catalyze CO combustion in the regenerators.

Sulfur oxide ($SO_X$) emissions may be controlled on the high activity side of the process by the addition of 0.1 to 25 weight percent gamma alumina to the cracking catalyst as disclosed in U.S. Pat. No. 4,115,251. We have found that $SO_X$ is controlled by adding 35 to 50 weight percent uncombined alumina to the cracking catalyst.

In the process of this invention, hydrocarbon oil feedstocks charged to the riser reactors 12 and 66 are preferably preheated to an elevated temperature in the range of about 204 C. (400 F.) to about 400 C. (750 F.). Preferably, the preheat temperature of the hydrocarbon feedstock does not exceed the temperature at which substantial thermal cracking begins to occur. Additional heat required to raise the temperature of the hydrocarbon in the reaction zone to the desired reaction temperature of 400 to 500 C. (about 750 to 930 F.) is provided by the hot regenerated catalyst entering the reactor at a temperature in the range of from about 675 to 790 C. (about 1250 F. to about 1450 F.). The total pressure in the system is preferably in the range of 5 to 15 psig (135 to 200 kPa). Preferred reaction conditions are further illustrated in the following specific example of a preferred embodiment of the process of this invention.

With hydrocarbon feedstocks containing high contents of nitrogen compounds, e.g., shale oils, hydrotreating of the feedstock is often employed to reduce its nitrogen content prior to charging the feedstock to a FCCU. Hydrotreating of petroleum hydrocarbons for the removal of sulfur and nitrogen compounds is a well known process, e.g. see "Petroleum Processing", November 1956, pages 116–138. Reaction conditions are generally within the range of 200 to 480 C. (about 400 to 900 F.), pressures of 3,550 to 34,575 kPa (500 to 5000 psig), hydrogen feed rates in the range of 178 to 3568 $M^3/M^3$ (1000 to 20,000 standard cubic feet per barrel) and space velocities in the range of 1 to 20 volumes of oil per volume of catalyst per hour. A suitable hydrotreating process and catalyst therefor is disclosed in U.S. Pat. No. 3,953,321, incorporated herein by reference. In the process of this invention hydrotreating may be used to improve the quality of the feedstock to the second riser reactor or high activity side of the process. In such instances, a preferred embodiment of the invention involves hydrotreating the whole gas oil fraction from the first reactor and charging the hydrotreated gas oil to the second reactor. This embodiment of the process of the invention, not illustrated in the FIGURE, is exemplified in the second of the following examples.

EXAMPLE 1

The present invention is employed in the FC cracking of atmospheric residuum from Arabian Light crude in a two stage cascade flow FCCU as described above and illustrated in the FIGURE. Inspection data on the feedstock are shown in Table I.

TABLE I

| ARABIAN LIGHT ATMOSPHERIC RESIDUUM CHARGE STOCK TEST RESULTS | |
|---|---|
| API, Gravity | 17.5 |
| Sulfur, wt % | 2.90 |
| Total Nitrogen, wppm | 1382 |
| Basic Nitrogen, wppm | 540 |
| Carbon Residue, wt % | 7.82 |
| Watson Aromatics, wt % | 63.7 |
| Metals, wppm | |
| Ni | 7 |
| V | 21 |
| ASTM Distillation, degrees C. (F.) | |
| 5 vol % | 324 (615) |
| 50 vol % | 513+ (956+) |
| TBP* Distillation, degrees C. (F.) | |
| Initial Boiling Point | 238 (460) |
| 50 wt % | 469 (877) |
| 99.9 wt % | 787 (1448) |

*True Boiling Point

The hydrocarbon feed contains a high metals content (catalyst poison) comprising in parts per million by weight (wppm) 7 wppm nickel and 21 wppm vanadium. The hydrocarbon feed is introduced into the riser reactor on the low activity side at a rate of 377,253 Kg/hr (831,700 pounds per hour) at a temperature of 371 C. (700 F.). Regenerated low activity catalyst contacts the feed at a rate of 1,033,787 Kg/hr (2,279,000 pounds per hour) a catalyst to oil ratio of 2.74, and a temperature of 682 C. (1260 F.). The temperature of the resulting equilibrium catalyst and oil mixture is 480.5 C. (897 F.). The average residence time in the riser is 5 seconds. Coked catalyst particles are separated from the hydrocarbon stream in the cyclone separators and steam stripped to remove volatiles at a steam rate of 5443 Kg/hr (12,000 pounds per hour). The hydrocarbons passing overhead from the first reactor are sent to a condenser where the 210 C plus fraction is condensed. The condensate fraction comprising the total gas oil is sent to the high activity riser reactor and the 210 C and lighter fraction is processed for recovery of desirable products of the first reactor. The total gas oil (210 C plus fraction) has the properties shown in Table II.

TABLE II

| TOTAL GAS OIL FROM LOW ACTIVITY CATALYST ARABIAN LIGHT RESIDUUM CRACKING | |
|---|---|
| Gravity, API | 20.3 |
| Sulfur, wt % | 2.58 |
| Total Nitrogen, wppm | 830 |
| Basic Nitrogen, wppm | 209 |
| Carbon Residue, wt % | 1.74 |
| Watson Aromatics, wt % | 65.4 |
| Metals, wppm | |
| Ni | 1 |
| V | 1 |
| ASTM Distillation, degrees C. (F.) | |
| 5 vol % | 206 (402) |
| 50 vol % | 416 (780) |
| 70 vol % | 473 (884) |
| TBP Distillation, degrees C. (F.) | |

TABLE II-continued

| TOTAL GAS OIL FROM LOW ACTIVITY CATALYST ARABIAN LIGHT RESIDUUM CRACKING | |
|---|---|
| Initial Boiling Point | 195 (384) |
| 50 wt % | 409 (768) |
| 99.8 wt % | 787 (1449) |

Comparison of the data in Tables I and II shows that the first stage cracking step greatly improves the characteristics of the 210 C plus fraction of the residuum as a FCC feedstock. By the first stage FCC step, the metals contents are greatly reduced, the basic and total nitrogen contents are reduced, and the sulfur and carbon residue are reduced as compared with the initial feedstock. The resulting gas oil (210 C plus fraction) is superior FCC charge stock as compared to the original Arabian Light Residuum.

The total gas oil from the first reactor is introduced into the second riser reactor, or high activity side, at a rate of 251,018 Kg/hr (553,400 pounds per hour) at a temperature of 288 C. (550 F.). Regenerated high activity catalyst contacts the feed at a rate of 1,784,886 Kg/hr (3,935,000 pounds per hour), catalyst-oil ratio 7.11, and a temperature of 704 C. (1299 F.). The resulting temperature of the equilibrium catalyst and oil mixture is 538.3 C. (1001 F.). The average residence time in the riser is 5 seconds. Coked catalyst particles are separated from the hydrocarbon stream in the separator and the coked catalyst particles steam stripped to remove volatiles at a rate of 907 Kg/hr (2,000 pounds per hour steam). Exemplary process conditions and yields for the process of this invention as compared with a conventional FCC process are shown in Tables III and IV.

Typical reactor and regenerator operating temperatures, carbon on regenerated catalyst (CORC), and relative catalyst activities when charging a heavy residuum such as Arabian Light Atmospheric Residuum are shown in Table III.

TABLE III

REACTOR AND REGENERATOR OPERATING CONDITIONS FOR CONVENTIONAL AND CASCADE FLOW FCCU

| | First Stage Reactor | Second Stage Reactor | Conventional FCC Reactor |
|---|---|---|---|
| Riser Inlet Temp, C. (F.) | 371 (700) | 288 (550) | 372 (702) |
| Riser Outlet Temp, C. (F.) | 480.5 (897) | 538 (1001) | 554 (1030) |
| Regenerator Temp, C. (F.) | 682 (1260) | 704 (1299) | 679 (1255) |
| Carbon on Regenerated Catalyst | 0.11 | 0.12 | 0.17 |
| Relative Catalyst Activity | 29 | 61 | 36 |

The yields from this process are shown in Table IV. Yields from a conventional FCC operation charging atmospheric residuum are shown for comparison.

TABLE IV

YIELDS FROM CONVENTIONAL AND CASCADE FLOW FCCU WHEN CHARGING ARABIAN LIGHT RESIDUUM

| | Yields From First Stage Reactor* | Yields From Second Stage Reactor** | Total Yields From Cascade FCCU* | Yields From Conventional FCCU* |
|---|---|---|---|---|
| $H_2S$ | 0.35 | 0.50 | 0.68 | 0.75 |
| $H_2$ | 0.39 | 0.09 | 0.45 | 0.95 |

TABLE IV-continued

| YIELDS FROM CONVENTIONAL AND CASCADE FLOW FCCU WHEN CHARGING ARABIAN LIGHT RESIDUUM | | | | |
|---|---|---|---|---|
| | Yields From First Stage Reactor* | Yields From Second Stage Reactor** | Total Yields From Cascade FCCU* | Yields From Conventional FCCU* |
| $C_1$ | 0.76 | 1.93 | 2.04 | 3.90 |
| $C_2$= | 0.47 | 1.54 | 1.49 | 2.60 |
| $C_2$ | 0.72 | 1.73 | 1.87 | 3.55 |
| Total Dry Gas | 2.34 | 5.29 | 5.85 | 11.00 |
| $C_3$= | 1.50 | 5.05 | 4.86 | 5.80 |
| $C_3$ | 0.86 | 1.20 | 1.66 | 2.75 |
| i-$C_4$ | 0.97 | 1.30 | 1.83 | 1.95 |
| n-$C_4$ | 0.50 | 0.70 | 0.97 | 1.05 |
| $C_4$= | 1.50 | 5.60 | 5.23 | 5.20 |
| Total Debutanized | | | | |
| Light Naphtha | 8.73 | 18.58 | 21.09 | 14.10 |
| Heavy Naphtha | 3.90 | 15.82 | 14.43 | 10.50 |
| Total Debutanized | | | | |
| Naphtha | 12.63 | 34.40 | 35.52 | 24.60 |
| LCGO[1] | 66.54[3] | 21.83 | 14.52 | 10.80 |
| HCGO[2] | | 19.52 | 12.99 | 17.5 |
| Coke | 12.83 | 4.61 | 15.89 | 18.6 |
| Conversion, vol % | 32.28 | 62.55 | 74.60 | 75.00 |

*Yields are in weight percent of residuum feedstock
**Yields are based on gas oil charged from first to second stage reactor
[1]Light Cycle Gas Oil
[2]Heavy Cycle Gas Oil
[3]Charged to High Activity Side As can be seen from Table IV, by the process of this invention, the coke yield is lower, the total dry gas is lower and the heavy cycle gas oil yield is lower than for conventional FCC processes using this residuum charge stock, whereas the total debutanized naphtha and light cycle gas oil (motor fuel fractions) yields are higher. Thus, this process allows the optimum use of heavy oil charge stocks as exemplified by Arabian Light Atmospheric Residuum.

EXAMPLE 2

The process of the present invention is employed in the FC cracking of Paraho Shale Oil in a two stage cascade flow FCCU as described above and shown in the figure. The feedstock quality of the synthetic crude hydrocarbon feedstock, Paraho Shale Oil, is shown in Table V. In this example, comparison is made between the process of this invention and conventional FCC processing of this type charge stock. In this example, raw shale oil is charged to the first stage FCC riser reactor of the process of this invention, the full range gas oil from the first stage reactor is hydrotreated and the hydrotreated gas oil is charged to the second stage FCC riser reactor.

As a basic for comparison, Paraho Shale Oil is first hydrotreated and the hydrotreated shale oil charged to a conventional riser reactor FCC unit.

TABLE V

| PARAHO SHALE OIL CHARGE STOCK TEST RESULTS | | |
|---|---|---|
| | Unhydrotreated | Hydrotreated |
| Gravity, API | 18.0 | 23.3 |
| Sulfur, wt % | 0.62 | 0.13 |
| Total Nitrogen, wt % | 2.09 | 1.25 |
| Basic Nitrogen, wt % | 1.56 | 0.95 |
| Carbon Residue, wt % | 0.70 | 0.12 |
| Watson Aromatics, wt % | 73.4 | 57.0 |
| Metals, wppm | | |
| Ni | 0 | 0 |
| V | 0 | 0 |
| ASTM Distillation, C. (F.) | | |

TABLE V-continued

| PARAHO SHALE OIL CHARGE STOCK TEST RESULTS | | |
|---|---|---|
| | Unhydrotreated | Hydrotreated |
| 5 vol % | 398 (749) | 389 (732) |
| 50 vol % | 463 (865) | 444 (831) |
| 90 vol % | 513+ (956+) | 513+ (956+) |
| Hydrotreater Conditions | | |
| Pressure, kPa (psig) | — | 10,790 (1550) |
| Temperature, C. (F.) | — | 354 (670) |
| Liquid Space Velocity, LHSV[1] | — | 1.0 |
| $H_2$ Feed Gas $M^3/M^3$ (SCFB)[2] | — | 1,069 (6000) |

[1]Liquid hourly space velocity
[2]Standard cubic meters per cubic meter (standard cubic feet per barrel)

As evident from the above table, this typical shale oil feedstock contains a high nitrogen content (catalyst poison) amounting to 1.56 weight percent basic nitrogen and 2.09 weight percent total nitrogen.

Unhydrotreated shale oil feedstock is introduced into the riser reactor on the low activity side of the two stage process of this invention at a rate of 125,328 Kg/hr (276,300 pounds per hour) and a temperature of 408 C. (766 F.) Regenerated low activity catalyst contacts the feed at a rate of 452,413 Kg/hr (997,400 pounds per hour) at a catalyst to oil ratio of 3.6 and a temperature of 649 C. (1200 F.). The temperature of the resulting equilibrium catalyst and oil mixture is 493 C. (920 F.). The average residence time in the first riser reactor is 6 seconds. Coked catalyst particles are separated from the hydrocarbon stream and steam stripped to remove volatiles at a rate of 454 Kg/hr (1,000 pounds of steam per hour. The hydrocarbons passing overhead from the reactor are sent to a separator where the total gas oil is condensed and separated from lower boiling materials.

The total gas oil, 210 C+ fraction of the product of the first reactor is hydrotreated under conditions effective for removal of additional amounts of the nitrogen-containing compounds. The hydrotreater operation conditions and the quality data for the unhydrotreated and hydrotreated total gas oils are shown in Table VI.

TABLE VI

UNHYDROTREATED AND HYDROTREATED TOTAL GAS OIL FROM LOW ACTIVITY CATALYST PARAHO SHALE OIL CRACKING

| Description | Unhydrotreated Total Gas Oil | Hydrotreated Total Gas Oil |
|---|---|---|
| Gravity, API | 19.3 | 24.7 |
| Sulfur, wt % | 0.40 | 0.01 |
| Total Nitrogen, wt % | 1.22 | 0.61 |
| Basic Nitrogen, wt % | 0.95 | 0.11 |
| Carbon Residue, wt % | 1.38 | 0.80 |
| Watson Aromatics, wt % | 74.7 | 58.3 |
| Metals, wppm | | |
| Ni | 0 | 0 |
| V | 0 | 0 |
| ASTM Distillation C. (F.) | | |
| 5 vol % | 249 (480) | 238 (460) |
| 50 vol % | 381 (718) | 371 (700) |
| 90 vol % | 513+ (956+) | 513+ (956+) |
| Hydrotreater Conditions | | |
| Pressure, kPa (psig) | — | 10,790 (1550) |
| Temperature, F. | — | 354 (670) |
| Liquid Space Velocity, LHSV[1] | — | 1.0 |
| $H_2$ Feed Gas Rate, $M^3/M^3$ (SCFB)[2] | — | 1,069 (6000) |

[1]Liquid hourly space velocity
[2]Standard cubic meters per cubic meter (standard cubic feet per barrel)

The hydrotreated total gas oil is then fed to the second or high activity riser reactor while the 210 C and lighter hydrocarbon components are processed for recovery of motor fuels and gaseous by-products.

The total gas oil from the hydrotreater is introduced into the second riser reactor at a rate of 97,160 Kg/hr (214,200 pounds per hour) at a temperature of 413 C. (775 F.). Regenerated high activity catalyst contacts the feed at a rate of 321,597 Kg/hr (709,000 pounds per hour), at a catalyst to oil ratio of 3.31 and at a temperature of 704 C. (1299 F.). The resulting equilibrium catalyst and oil mixture is 493 C. (920 F.). The average residence time in the riser is 6 seconds. Coked catalyst particles are separated from the hydrocarbon product stream and the coked catalyst particles steam stripped at a rate of 318 Kg/hr (700 pounds per hour) of steam. The resulting hydrocarbon stream is sent to a recovery section.

Typical reactor and regenerator operating temperatures, carbon on regenerated catalyst (CORC), and relative catalyst activities when charging a heavy residuum such as Paraho Shale Oil are shown in Table VII.

TABLE VII

REACTOR AND REGENERATOR OPERATING CONDITIONS FOR CONVENTIONAL AND CASCADE FLOW FCCU

| | First Stage Reactor | Second Stage Reactor | Conventional FCC Reactor |
|---|---|---|---|
| Riser Inlet Temp, C. (F.) | 408 (766) | 413 (775) | 408 (766) |
| Riser Outlet Temp, C. (F.) | 493 (920) | 493 (920) | 493 (920) |
| Regenerator Temp, C. (F.) | 649 (1200) | 704 (1299) | 624 (1156) |
| Carbon on Regenerated Catalyst | 0.12 | 0.12 | 0.22 |
| Relative | 29 | 56 | 56 |

TABLE VII-continued

REACTOR AND REGENERATOR OPERATING CONDITIONS FOR CONVENTIONAL AND CASCADE FLOW FCCU

| | First Stage Reactor | Second Stage Reactor | Conventional FCC Reactor |
|---|---|---|---|
| Catalyst Activity | | | |

Yields from a conventional FCCU with hydrotreated and unhydrotreated Paraho Shale Oil as charge stock are shown in Table VIII; yields from Cascade Flow FCCU, are shown for comparison in Table IX.

TABLE VIII

YIELDS FROM CONVENTIONAL FCCU

| Description | Hydrotreated | Unhydrotreated |
|---|---|---|
| $H_2S$ | 0.03 | 0.16 |
| Total Dry Gas | 3.67 | 8.72 |
| $C_3$= | 0.64 | 0.67 |
| $C_3$ | 1.82 | 2.36 |
| i-$C_4$ | 3.56 | 2.20 |
| n-$C_4$ | 1.41 | 0.64 |
| $C_4$= | 1.81 | 3.48 |
| Total DB Naphtha | 38.01 | 18.22 |
| LCGO | 19.80 | 24.51 |
| HCGO | 10.48 | 11.84 |
| Coke | 18.76 | 27.20 |
| Conversion vol % | 63.00 | 63.00 |

TABLE IX

YIELDS FROM CASCADE FLOW FCCU

| Description | Yields From First Stage Reactor | Yields From Second Stage Reactor | Total Yields From Cascade FCCU |
|---|---|---|---|
| Yields, wt % FF | | | |
| $H_2S$ | 0.24 | 0.01 | 0.25 |
| Total Gas Dry | 6.75 | 3.62 | 9.56 |
| $C_3$= | 0.17 | 2.75 | 2.30 |
| $C_3$ | 2.08 | 1.93 | 3.58 |
| i-$C_4$ | 0.26 | 6.96 | 5.65 |
| n-$C_4$ | 0.28 | 0.95 | 1.02 |
| $C_4$= | 0.95 | 4.31 | 4.29 |
| Total DB Naphtha | 3.47 | 46.04 | 39.16 |
| LCGO | 77.52[1] | 20.04 | 15.54 |
| HCGO | | 8.14 | 6.31 |
| Coke | 8.28 | 5.25 | 12.34 |
| Conversion, vol % | 21.34 | 72.20 | 77.48 |

[1]Charged to Second Stage

Comparison of the yields in Tables VIII and IX indicate the advantages of the present process as compared with a conventional FCC process. The advantages of first cracking the shale oil and then hydrotreating the total gas oil are (1) some of the nitrogen compounds are removed during the cracking stage resulting in lowering the nitrogen content in the feedstream to the hydrotreater is reduced. The hydrotreating step allows a further reduction in the nitrogen content of the total gas oil.

It is claimed:

1. In a process for the fluid catalytic cracking of heavy hydrocarbon feedstocks containing catalyst poisons wherein spent catalyst from said catalytic cracking reaction is stripped of volatile hydrocarbons prior to regeneration and stripped catalyst is regenerated by burning coke therefrom with an oxygen-containing gas, the improvement which comprises contacting said heavy hydrocarbon feedstock in a first fluidized catalytic cracking reaction zone with a zeolite type cracking catalyst having a substantial but relatively low catalytic cracking activity as compared with fresh catalyst, passing stripped catalyst from said first reaction zone to a first dense phase fluidized bed catalyst regeneration zone of a catalyst regeneration system comprising multiple catalyst regeneration zones, recovering a gas oil fraction from products of reaction of said first reaction zone, and contacting said gas oil fraction in a second fluidized catalytic cracking zone with a zeolite type cracking catalyst of relatively high catalytic activity as compared with the catalyst in said first reaction zone, passing stripped catalyst from said second cracking zone to a second dense phase fluidized bed catalyst regeneration zone, supplying sufficient oxygen-containing regeneration gas to said regeneration zones to provide an excess of oxygen over that required for complete combustion of coke to carbon dioxide, discharging flue gases substantially free from carbon monoxide from said regeneration zones, adding fresh catalyst to said catalyst regenerated in said second regeneration zone, withdrawing used catalyst from said second regeneration zone and introducing said used catalyst into said first regeneration zone as the source of catalyst therefor, and discharging used catalyst from said first regeneration zone.

2. A process according to claim 1 wherein the catalyst for said second or high activity reaction zone is a high activity molecular sieve type cracking catalyst and the catalyst for said first or low activity cracking reaction zone comprises used molecular sieve cracking catalyst from said second catalyst reaction zone.

3. A process according to claim 2 wherein said molecular sieve catalyst contains a platinum group metal promoter for the conversion of carbon monoxide to carbon dioxide.

4. A process according to claim 2 wherein said high activity zeolite catalyst comprises a calcium A zeolite.

5. A process according to claim 1 wherein catalyst from said first reaction zone is regenerated with air in a first regeneration zone and catalyst from said second reaction zone is regenerated in a second regeneration zone with effluent gases from said first regeneration zone.

6. A process according to claim 5 in which a supplemental quantity of air is supplied to said second regeneration zone in admixture with gases from said first regeneration zone as fluidizing and regeneration gases for said second regeneration zone.

7. A process according to claim 6 wherein uncombined alumina is admixed with said catalyst in said regeneration zones.

8. A process according to claim 7 in which the catalyst supplied to said second regeneration zone comprises 10 to 15 weight percent gamma alumina.

9. A process according to claim 1 wherein said gas oil fraction comprises all products of said first reaction zone boiling above 410° F.

10. A process according to claim 9 wherein said gas oil fraction from said first reaction zone is subjected to hydrotreating and the hydrotreated gas oil fraction is supplied to said second reactor as hydrocarbon feedstock for said second reactor.

11. A process according to claim 1 wherein said heavy hydrocarbon feedstock contains nitrogen compounds and wherein a gas oil fraction from said first reaction zone is contacted with hydrogen under reaction conditions effective for the removal of at least a portion of said nitrogen compounds from said gas oil, and the resulting hydrotreated gas oil is feedstock to said second catalytic reaction zone.

12. A process according to claim 11 in which the heavy hydrocarbon feedstock is shale oil.

13. A process according to claim 11 in which the heavy hydrocarbon feedstock is tar sand bitumen.

14. A process according to claim 9 wherein said heavy hydrocarbon oil feedstock is a crude oil residuum.

15. In a fluidized catalytic hydrocarbon conversion process wherein spent catalyst from said hydrocarbon conversion reaction is stripped of volatile hydrocarbons prior to regeneration and stripped catalyst regenerated by burning coke therefrom with an oxygen-containing gas, the improvement which comprises contacting a heavy hydrocarbon feedstock containing catalyst poisons in a first riser reaction zone with a catalyst having relatively low activity as compared with fresh catalyst, passing stripped catalyst from said first reaction zone to a first dense phase fluidized bed catalyst regeneration zone of a catalyst regeneration system comprising multiple catalyst regeneration zones, maintaining a dense phase fluidized bed of catalyst in said first regeneration zone by the introduction of primary regeneration air into the lower portion of said first regeneration zone at a rate sufficient to cause fluidization of said catalyst particles and regeneration of said catalyst with the production of gaseous reaction products comprising carbon oxides, separating a heavy hydrocarbon fraction comprising gas oils from the products of said first reaction zone, passing said heavy hydrocarbon fraction to a second riser reaction zone into contact with cracking catalyst of higher catalytic activity than the catalyst in said first riser reaction zone, passing stripped catalyst from said second riser reaction zone to a second dense phase fluidized bed catalyst regeneration zone, passing gaseous reaction products from said first catalyst regeneration zone into the lower portion of a second catalyst regeneration zone, supplying sufficient air to said first and second regeneration zones to provide an excess of oxygen over that required for complete combustion of coke to carbon dioxide, discharging flue gases substantially free from carbon monoxide from said second regeneration zone, adding fresh catalyst to said second regeneration zone, withdrawing used catalyst from said second regeneration zone and introducing said used catalyst into said first regeneration zone and discarding used catalyst from said first regeneration zone.

* * * * *